US008096143B1

(12) United States Patent
White et al.

(10) Patent No.: US 8,096,143 B1
(45) Date of Patent: Jan. 17, 2012

(54) PORTABLE BOX WINE BAR

(76) Inventors: Richard W. White, Lake Worth, FL (US); Robert J. White, Lake Worth, FL (US)

( * ) Notice: Subject to any disclaimer, the term of this patent is extended or adjusted under 35 U.S.C. 154(b) by 925 days.

(21) Appl. No.: 12/151,340

(22) Filed: May 6, 2008

Related U.S. Application Data

(63) Continuation-in-part of application No. 12/082,435, filed on Apr. 10, 2008, now Pat. No. 7,861,892.

(60) Provisional application No. 61/068,060, filed on Mar. 4, 2008.

(51) Int. Cl.
*F25D 3/00* (2006.01)
*B67D 7/78* (2010.01)
*B67D 3/00* (2006.01)

(52) U.S. Cl. ..... 62/389; 222/131; 222/539

(58) Field of Classification Search ..... 62/389, 62/400, 457.4, 457.5; 222/146.6, 188, 131, 222/182, 539, 183
See application file for complete search history.

(56) References Cited

U.S. PATENT DOCUMENTS 3,232,489 A * 2/1966 Buffington ..... 222/108
4,699,342 A * 10/1987 Bartz et al. ..... 248/150
4,812,054 A 3/1989 Kirkendall
5,535,883 A 7/1996 Henderson
6,269,965 B1 * 8/2001 White et al. ..... 220/592.18
6,334,329 B1 1/2002 Weller
6,554,164 B1 4/2003 Jones
6,595,475 B2 7/2003 Svabek
6,651,456 B1 * 11/2003 White et al. ..... 62/457.7
6,736,289 B2 * 5/2004 Wolf et al. ..... 222/105
7,080,758 B2 7/2006 Jones
7,137,533 B1 11/2006 Heath
7,780,034 B1 * 8/2010 Richardson ..... 220/592.18
2003/0006243 A1 1/2003 Looney
2005/0023292 A1 * 2/2005 Market et al. ..... 222/105

* cited by examiner

*Primary Examiner* — Frantz Jules
*Assistant Examiner* — Cassey D Bauer
(74) *Attorney, Agent, or Firm* — Alvin S. Blum

(57) ABSTRACT

A portable wine box bar has an insulated chamber with an open top, an insulated cover for the open top, and a horizontal shoulder on the inside wall near the top. A rigid panel fits on the shoulder. A support affixed to the panel supports bag-in box containers of wine with outlets supported above the panel high enough to allow containers to be supported on the panel while filling from the outlet. Perforations in the panel and a drip tray below the tap outlet capture spills. A panel aperture permits access to items such as soft drinks stored in the chamber. When not in use, the panel may be inverted and returned to the shoulder. With the cover in place it is insulated, secure, and transportable.

13 Claims, 5 Drawing Sheets

PORTABLE BOX WINE BAR

This application is a continuation-in-part of U.S. patent application Ser. No. 12/082,435 filed Apr. 10, 2008, now U.S. Pat. No. 7,861,892 which claims the benefit of provisional application for patent No. 61/068,060 filed Mar. 4, 2008.

FIELD OF THE INVENTION

This invention relates to self-contained portable apparatus for dispensing beverages from a plurality of containers for consumption by consumers in a bartending operation, and more specifically to such apparatus for dispensing beverage from bag-in-box containers into drinking receptacles supported on a surface.

BACKGROUND OF THE INVENTION

Portable draft boxes and bars for dispensing beverages are well known in the art, as exemplified by U.S. Pat. Nos. 6,334,329 issued Jan. 1, 2002 to Weller; 6,595,475 issued Jul. 22, 2003 to Svabek; 5,339,986 issued Aug. 23, 1994 to Mihalich; 1,772,111 issued Aug. 5, 1930 to Rice; 6,481,238 issued Nov. 19, 2002 to Jennings; and 5,915,602 issued Jun. 29, 1999 to Nelson. Many are large and cumbersome. Bag-in-box beverage packages are often produced for providing a large volume, 3 liters or more, of wine in a package that dispenses wine without admitting air. They are more economical than bottles, easier to handle, and environmentally friendly. They have a dispensing outlet at a low position, so that the outlet must be positioned over the edge of a support surface. A drinking receptacle must then be hand held below the outlet for filling. This is awkward when dispensing many portions at a public gathering.

SUMMARY OF THE INVENTION

It is accordingly an object of the invention to provide a self-contained portable apparatus for dispensing beverages from many bag-in box containers that may be used in a bartending operation. When wine is being served, it is common to offer at least one red and one white wine choice. Bag-in-box wine packages are most economical. They hold a large volume, and they are more easily handled that bottles. The apparatus of the invention includes a flat rigid panel with two broad opposed faces that is dimensioned to fit on the inner shoulder of an insulated cooler having a hinged and/or removable insulated cover. Support for at least two bag-in-box containers is affixed to a first face of the panel. The containers are suspended above the first face high enough so that the outlet of the container will be at least four inches above the first face to enable a receptacle such as a cup or glass to fit under the outlet while resting on the panel. A perforated surface is provided on the panel with a pan receiving the drippings under the panel. The perforated surface and pan are positioned below the outlets to catch all the drips that would otherwise contaminate the dispensing area. The pan may optionally be provided with an outlet and a removable bag for receiving larger amounts of waste liquid. The term outlet is used here to designate any of the faucets, valves and spigots used to dispense liquids from the container. An opening with removable cover is provided in the panel to permit access to the ice chamber below that may hold soft drinks, water bottles, and the like. Another opening may be provided in the panel to receive an elongate cylinder open at the top and closed at the bottom. This is constructed to receive nested drinking receptacles for ready access to the dispensing operation.

The panel and its accessories are dimensioned and constructed so that, after the bag-in-box containers are removed, the panel may be lifted up, inverted, and again rested on the inner shoulder of the cooler. This maneuver enables the insulated cover of the cooler to close. This facilitates safe transport and avoids melting of the ice.

These and other objects, features, and advantages of the invention will become more apparent from the detailed description of exemplary embodiments thereof as illustrated in the accompanying drawings, in which like elements are designated by like reference characters in the various drawing figures.

DETAILED DESCRIPTION OF PREFERRED EMBODIMENTS

Figure 1:
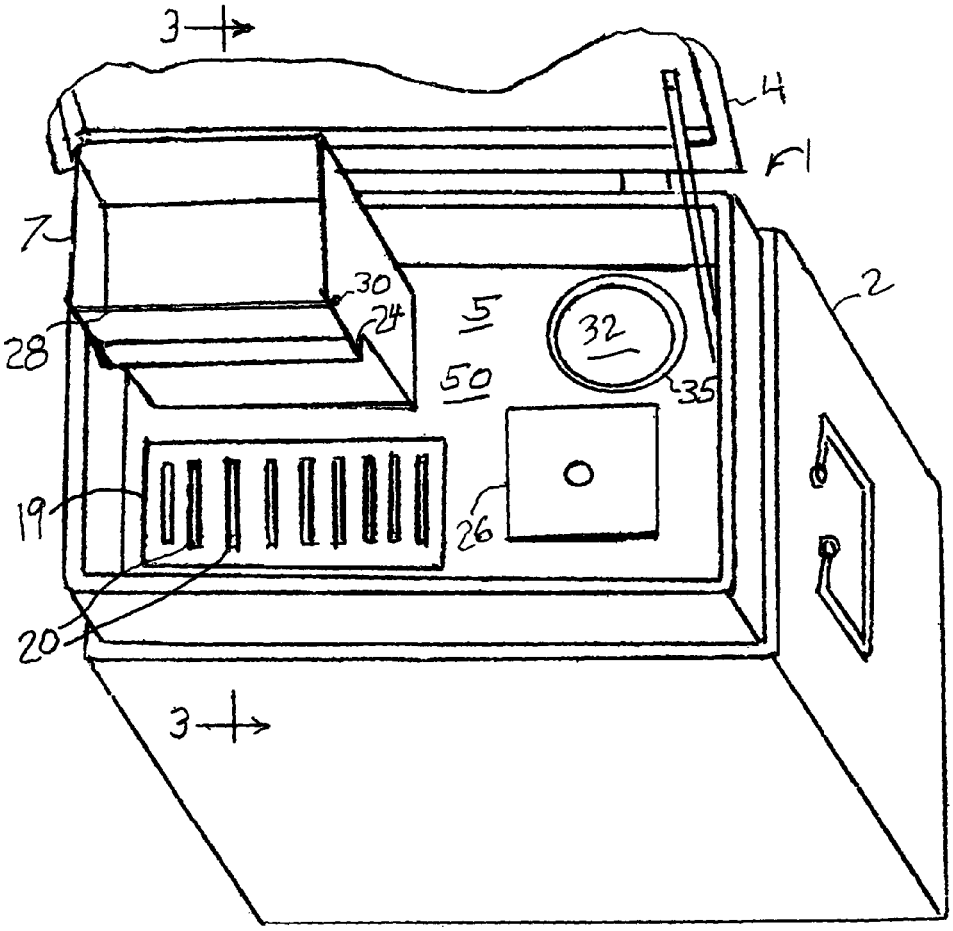
FIG. 1 is a perspective view of the invention with cover open ready for use.

Referring now to the drawing FIGS. 1-5, a preferred embodiment of the portable box wine bar 1 is shown. A flat rigid panel 5 has broad first face 50, opposed second face 51, and is dimensioned to fit on the inner shoulder 3 of insulated cooler 2. The cooler 2 has insulated side walls 10, an insulated bottom 11, and an open top 12. An insulated cover 4 covers the open top. The cover may be hinged and/or removeable.

Figure 3:
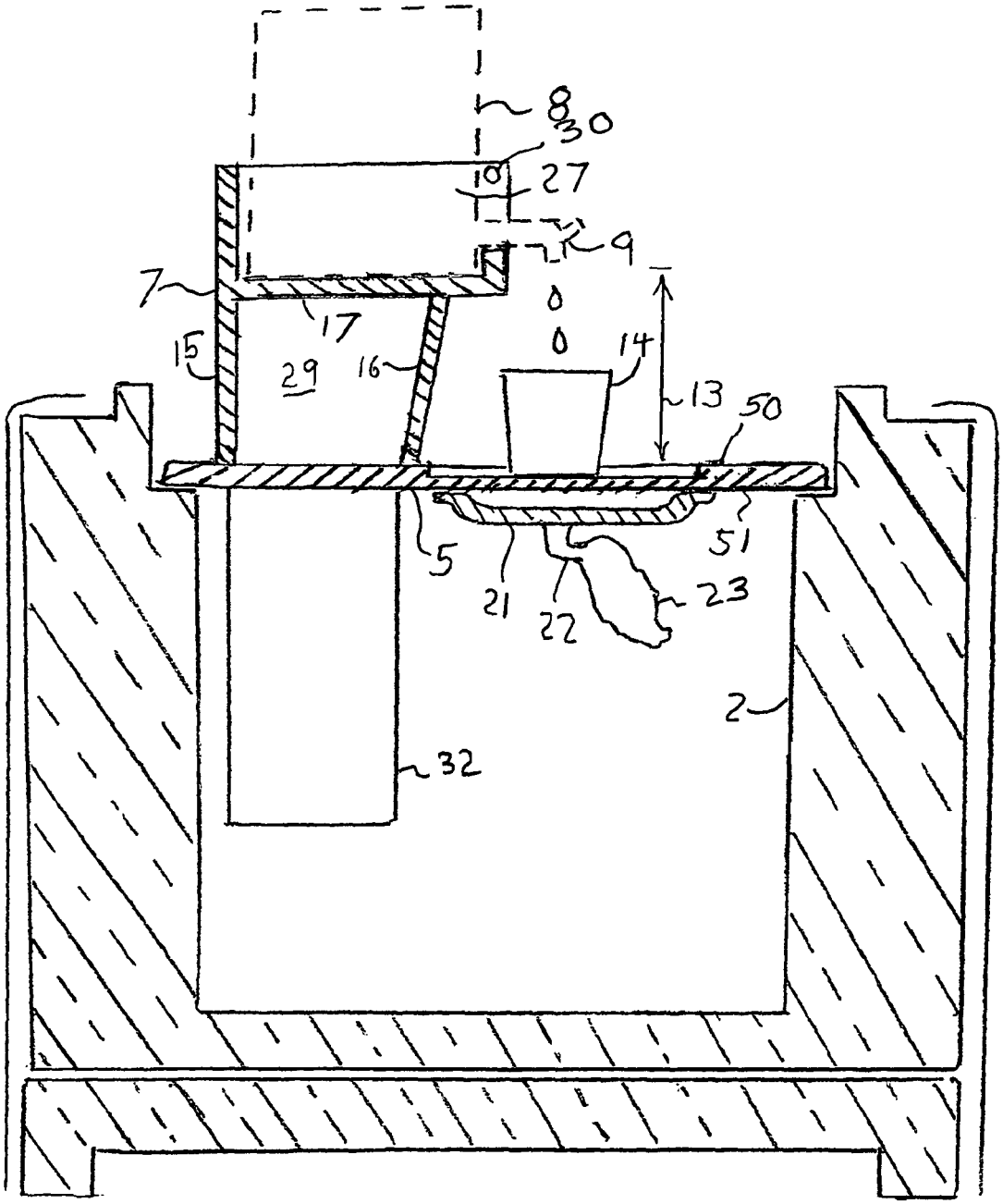
FIG. 3 is an enlarged sectional view through line 3-3 of FIG. 1.
Figure 4:
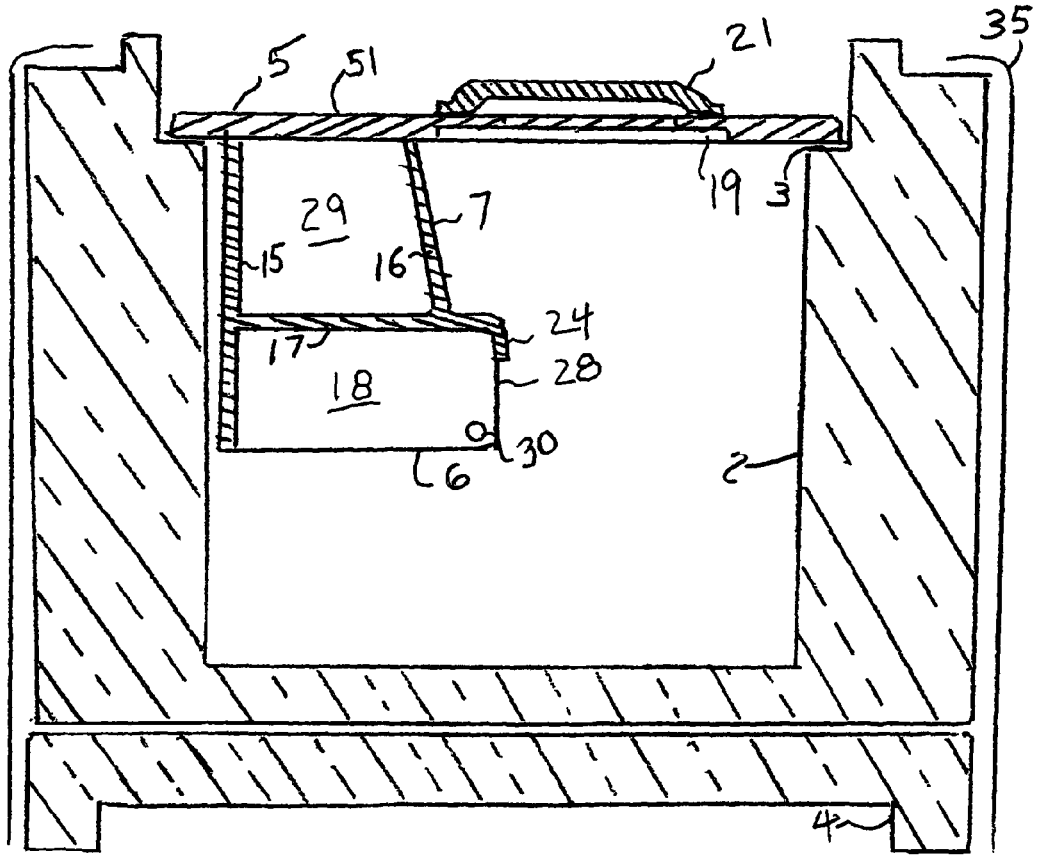
FIG. 4 is an enlarged sectional view through line 4-4 of FIG. 2.
Figure 5:
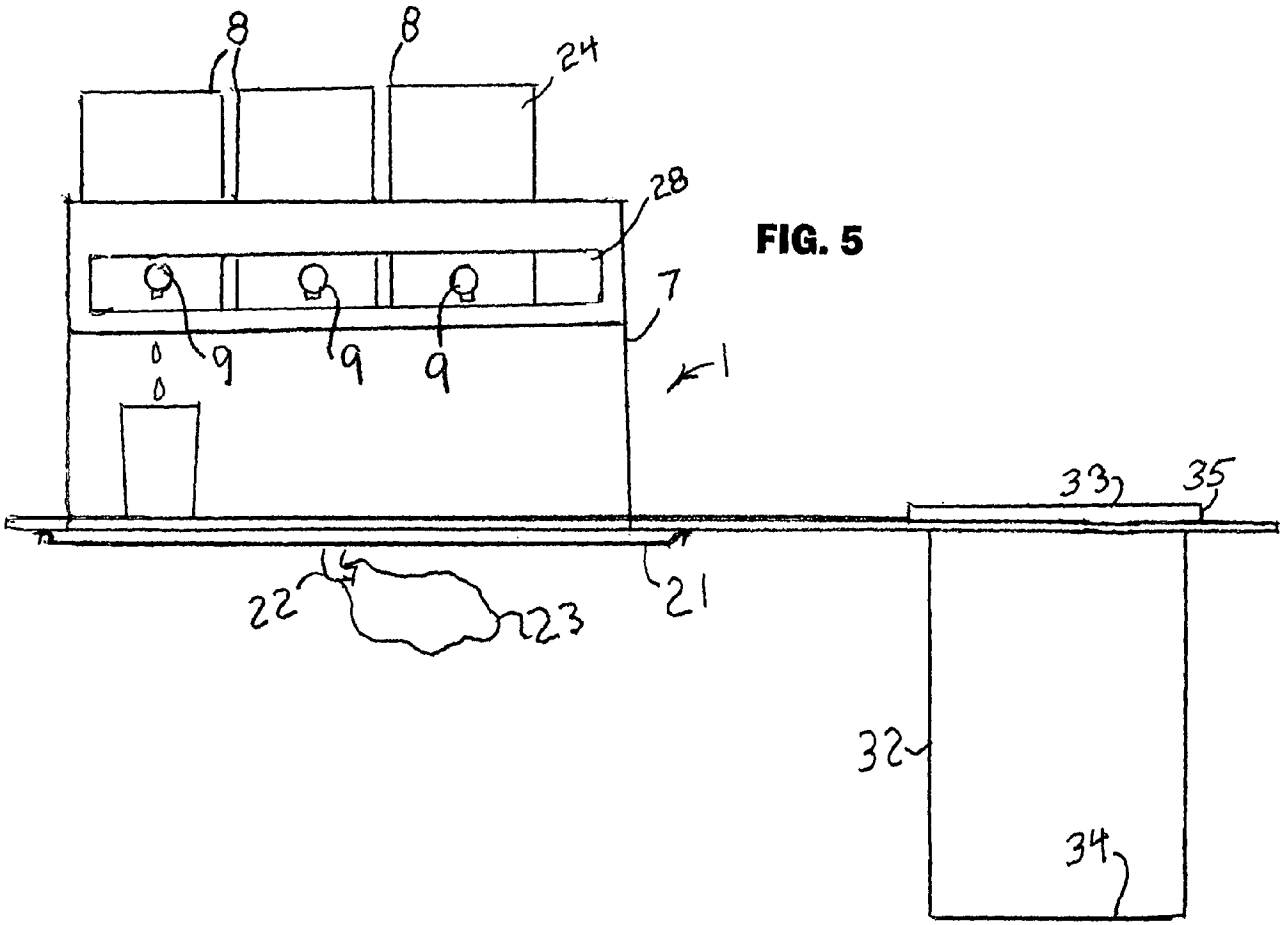
FIG. 5 is a front elevation view of a panel of the invention.

A support 7 designed to hold two or more wine boxes, or bag-in-box containers, 8 is affixed to the panel 5 and extends upward from its first face 50 so that the wine boxes are above the open top of the cooler 2. The outlet 9 of each of the bag-in-box containers is thereby supported above the first surface 50 of the panel a distance of at least four inches to enable a receptacle such as a cup 14 to rest on the panel below the outlet. The support 7 has a generally U-shaped portion 18 with an open top 6 and a flat bottom 17 to receive the lower portion 27 of the wine box. The front 24 of the U-shaped portion has openings 28 to pass the outlets 9 of the wine boxes. This opening 28 may be formed by cutting away a portion of the front portion 24 as shown in FIG. 5. Alternatively, as shown in FIGS. 1, 3, and 4, a rod 30 affixed above a lower front portion 24 forms the opening 28.

The U-shaped portion 18 is held above the panel 5 by a rear member 15 and a front member 16. A storage space 29 is defined by the members 15 and 16, and the bottom 17. This may be accessed by apertures (not shown) in the panel or an open side of the support to hold cooling items, napkins, cups, and the like. The support 7 may be fabricated in many ways. It may be made from folded sheet material, or it may be extruded in metal or plastic. When extruded from a transparent plastic material, information on the wine boxes may be read by the consumer.

There is often a drip or overflow in the dispensing process. The apparatus provides for means to catch these drips and overflows so as to keep the environment clean and dry. A recessed area 20 below where the outlets 9 will be positioned has perforations 19 through which the waste liquid will flow. A receiving pan 21 mounted on the second face 51 receives the waste liquid. The pan 21 is provided with an outlet 22 to which a waste receiving bag 23 may be removably connected.

An aperture 25 in the panel is large enough to permit access to retrieve items such as cooling cans and bottles. It also permits access to add or remove ice as desired. The aperture 25 is covered by removable cover 26.

A source of drinking vessels such as cups or glasses may optionally be provided with the bar. A tubular container 32 has a closed bottom 34, an open top 33, and a lip 35 so that it can rest in an aperture 36 in the panel 5. The drinking vessels will be at hand and safely concealed. The container 32 should be removed before inverting the panel for transport.

Figure 2:
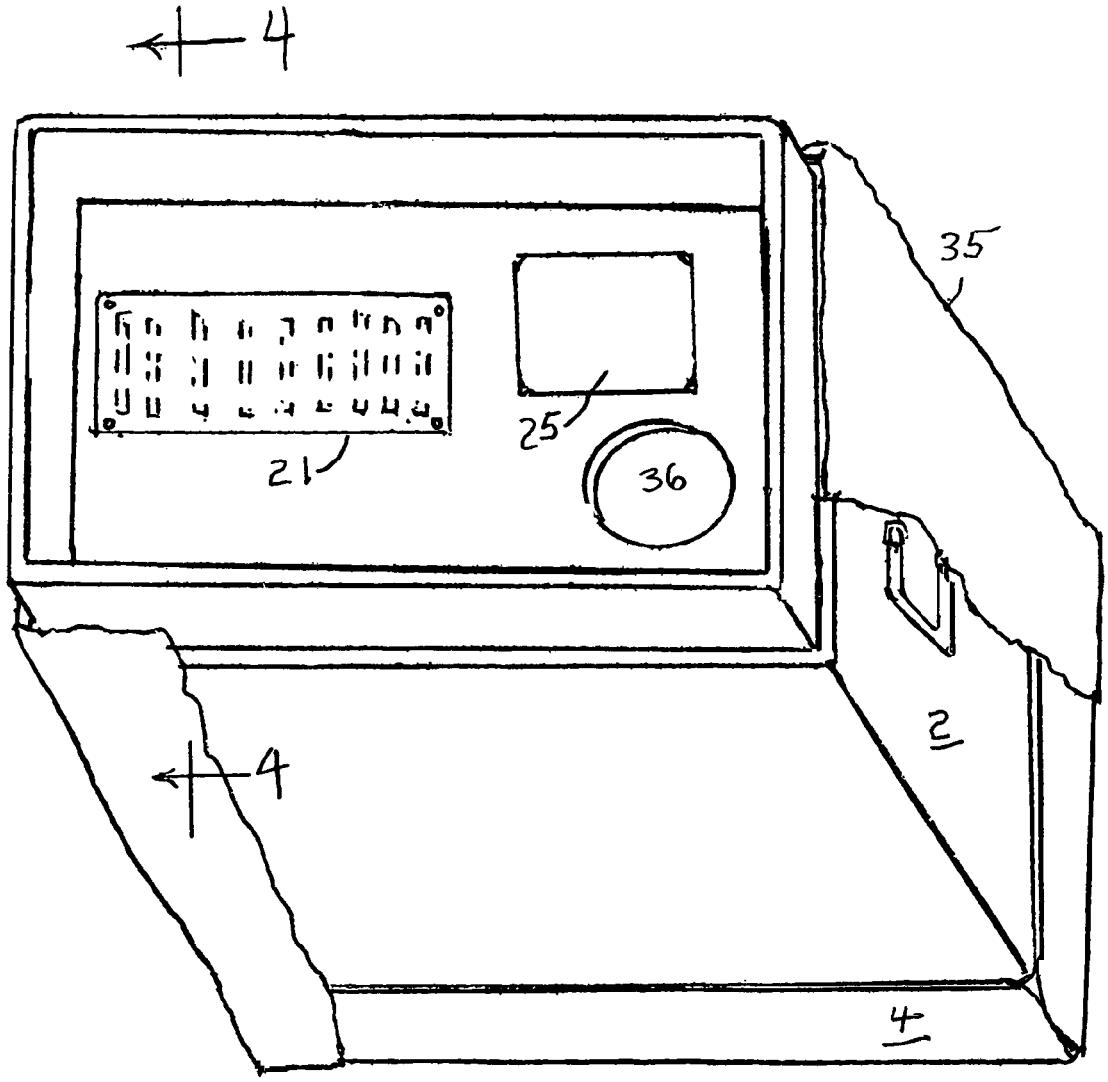
FIG. 2 is a perspective view with panel inverted, the cover underneath, and a partially cut away skirt.

The panel 5 may be lifted out of the cooler 2, inverted and replaced on the inner shoulder 3 of the cooler, as best seen in FIGS. 2 and 4, with the second face uppermost. The insulated cover 4 may then be closed to prevent ice melting and provide for a more convenient and secure storage and/or transport.

A skirt 35 may be provided that covers the sides of the cooler. It may be decorative and embellished with logos, advertising, and the like.

While we have shown and described the preferred embodiments of our invention, it will be understood that the invention may be embodied otherwise than as herein specifically illustrated or described, and that certain changes in form and arrangement of parts and the manner of practicing the invention may be made within the underlying idea or principles of the invention.

The invention claimed is:

1. A portable wine bar comprising:

an insulated chamber having an open top, insulated side walls, and an insulated bottom;

an insulated top for covering the open top;

a horizontal shoulder extending around the inside of the side walls near the open top;

a rigid panel dimensioned to removably fit inside the chamber supported by the shoulder, the panel having opposed broad first and second faces;

a support for at least two bag-in-box containers affixed to the panel and extending from the first face and disposed so that a beverage outlet of a bag-in-box container having the outlet at a low position on the container will be removably supported thereon so that the outlet will be above the panel a distance of at least four inches for dispensing into a receptacle;

the support when viewed from the side having a generally U-shaped top portion having an open top and a flat bottom to receive a lower portion of the container thereon, the front of the U-shaped portion having openings to pass the outlets;

the U-shaped portion supported above the panel by front and rear members that define a storage space therebetween;

a perforated area in the first face disposed so as to be below said beverage outlet;

a receiving pan mounted below the perforated area to receive waste liquid;

the panel constructed so as to be supported on the shoulder in a first operating position in which the support for the at least two bag-in-box containers extends above the open top for dispensing beverage; and the panel constructed so as to be supported on the shoulder in an inverted, second operating position after the containers are removed, in which the support for the at least two bag-in-box containers extends downward into the chamber where it is protected and so that the insulated top may cover and insulate the chamber for transport.

2. The portable wine bar according to claim 1 further comprising a skirt for removably covering the side walls.

3. The portable wine bar according to claim 2 further comprising an elongate cylinder having an open top and a closed bottom removably mounted in an aperture in the first face.

4. The portable wine bar according to claim 1 further comprising an elongate cylinder having an open top and a closed bottom removably mounted in an aperture in the first face.

5. The portable wine bar according to claim 1 further comprising an aperture in the panel large enough to permit access to the chamber for retrieving ice and other items from the chamber in cooperation with a removable aperture cover.

6. The portable wine bar according to claim 4 further comprising an additional aperture in the panel large enough to permit access to the chamber for retrieving ice and other items from the chamber in cooperation with a removable aperture cover.

7. A portable bar for use with bag-in-box beverage containers having a dispensing outlet at a low position on the container, the bar comprising:

an insulated chamber having an open top, insulated side walls, and an insulated bottom;

an insulated top for covering the open top;

a horizontal shoulder extending around the inside of the side walls near the open top;

a rigid panel dimensioned to removably fit inside the chamber supported by the shoulder, the panel having opposed broad first and second faces;

a perforated area in the first face;

a support for at least two bag-in-box containers affixed to the panel and extending from the first face so as to support said containers by resting the containers on the support with said outlet on a bag-in-box above the perforated area;

the support when viewed from the side having a generally U-shaped top portion having an open top and a flat bottom to receive thereon a lower portion of the container, the front of the U-shaped portion having openings to pass the outlets;

the panel constructed so as to be supported on the shoulder in a first operating position in which the support for at least two bag-in-box containers extends above the open top for dispensing beverage at a level at least four inches above the panel first face; and the panel constructed so as to be supported on the shoulder in an inverted, second operating position after removal of the containers in which the support for the at least two bag-in-box containers extends downward into the chamber where it is protected and so that the insulated top may cover and insulate the chamber for transport.

8. The portable bar according to claim 7 further comprising an aperture in the panel large enough to permit access to the chamber for retrieving ice and other items from the chamber in cooperation with a removable aperture cover.

9. The portable bar according to claim 8 further comprising a skirt for removably covering the side walls of the chamber.

10. The portable bar according to claim 7 further comprising a skirt for removably covering the side walls of the chamber.

11. The portable wine bar according to claim 7 further comprising an elongate cylinder having an open top and a closed bottom removably mounted in an aperture in the first face for holding drinking vessels.

12. A portable bar for fitting inside an insulated chamber having an open top, insulated side walls, an insulated bottom, an insulated top for covering the open top, and a horizontal shoulder extending around the inside of the side walls near the open top, the bar comprising:

a rigid panel dimensioned to removably fit inside the chamber supported by the shoulder, the panel having opposed broad first and second faces;

a perforated area in the first face;

a support for at least two bag-in-box containers affixed to the panel and extending from the first face, the support constructed support the containers by resting the containers on the support so as to support an outlet above the perforated area;

the support when viewed from the side having a generally U-shaped top portion having an open top and a flat bottom to receive a lower portion of the container thereon, the front of the U-shaped portion having openings to pass the outlets;

the U-shaped portion supported above the navel by front and rear members that define a storage space therebetween;

the panel constructed so as to be supported on the shoulder in a first operating position in which the support for at least two bag-in-box containers extends above the open top for dispensing beverage at a level at least four inches above the panel first face; and the panel constructed so as to be supported on the shoulder in an inverted, second operating position in which the support for the at least two bag-in-box containers extends downward into the chamber after the containers have been removed, where it is protected and so that the insulated top may cover and insulate the chamber for transport.

13. The portable bar according to claim 12 further comprising:

a receiving pan mounted on the second face below the perforated area to receive waste liquid; and an outlet on the receiving pan for removably connecting a receiving bag.

* * * * *